US005971717A

United States Patent [19]

Berthold

[11] Patent Number: 5,971,717

[45] Date of Patent: Oct. 26, 1999

[54] AXIAL PISTON MACHINE HAVING A COOLING CIRCUIT FOR THE CYLINDERS AND PISTONS

[75] Inventor: Heinz Berthold, Horb, Germany

[73] Assignee: Brueninghaus Hydromatik GmbH, Elchingen, Germany

[21] Appl. No.: 08/765,341

[22] PCT Filed: Jun. 7, 1995

[86] PCT No.: PCT/EP95/02180

§ 371 Date: Mar. 4, 1997

§ 102(e) Date: Mar. 4, 1997

[87] PCT Pub. No.: WO96/00838

PCT Pub. Date: Jan. 11, 1996

[30] Foreign Application Priority Data

Jun. 30, 1994 [DE] Germany ..... 44 23 023

[51] Int. Cl.[6] ..... F04B 1/12; F04B 27/08

[52] U.S. Cl. ..... 417/269; 92/144; 92/154

[58] Field of Search ..... 92/154, 144; 417/269; 103/162

[56] References Cited

U.S. PATENT DOCUMENTS

| | | | |
|---|---|---|---|
| 3,089,426 | 5/1963 | Budzich | 103/162 |
| 5,088,897 | 2/1992 | Kawai et al. | 417/269 |
| 5,354,181 | 10/1994 | Porel | 417/269 |
| 5,486,098 | 1/1996 | Kimura et al. | 417/222.2 |

FOREIGN PATENT DOCUMENTS

| | | |
|---|---|---|
| 0 041 312 | 12/1981 | European Pat. Off. . |
| 41312 | 12/1981 | European Pat. Off. . |
| 1595812 | 7/1970 | France . |
| 1 267 985 | 5/1968 | Germany . |
| 1 403 754 | 1/1969 | Germany . |
| 1 804 529 | 7/1969 | Germany . |
| 28 12 418 | 10/1979 | Germany . |
| 1029910 | 5/1966 | United Kingdom . |
| 1 309 746 | 3/1973 | United Kingdom . |
| WO 90/15246 | 12/1990 | WIPO . |

*Primary Examiner*—Charles G. Freay
*Assistant Examiner*—Robert Z. Evora
*Attorney, Agent, or Firm*—Scully, Scott, Murphy & Presser

[57] ABSTRACT

An axial piston machine having a housing (1) the interior housing chamber of which includes a leakage chamber (37) and accommodates a stroke disc (3) and a rotatably mounted cylinder drum (6) having cylinders (26, 28) and pistons (29) reciprocally movable in the cylinders, the ends of which pistons projecting out of the cylinders (26, 28) bear on the stroke disc (3). In order to avoid piston seizures, while maintaining the efficiency of the axial piston machine, there is provided a cooling circuit.

14 Claims, 6 Drawing Sheets

AXIAL PISTON MACHINE HAVING A COOLING CIRCUIT FOR THE CYLINDERS AND PISTONS

BACKGROUND OF THE INVENTION

1. Field of the Invention

The invention relates to an axial piston machine.

Such axial piston machines are known in practice. In particular with swash plate machines, the normal force supporting each piston at the swash plate contains a radial component which acts upon the piston as on a beam mounted in the cylinder drum and skewing the piston within the cylinder. In particular with a lack of piston lubrication, such as occurs for example during the start-up phase, this leads to metallic contact between piston and cylinder wall with the consequence of corresponding heating through the frictional forces arising, and the danger of seizing of the piston.

2. Discussion of the Prior Art

From DE-OS 14 03 754 there is known an axial piston machine with which, for the purpose of avoiding the metallic contact between piston and cylinder, there are formed at the periphery of each cylinder or of the associated piston symmetrically formed pressure pockets which are connected via respective chokes and axial through-bores in the piston with the working chamber of the cylinder. The piston is lubricated and hydrostatically balanced by means of the oil, under high pressure, flowing into the pressure pockets from the working chamber during the compression stroke, and in this way the piston is centrally guided in the cylinder without the danger of skewing. The quantity of oil necessary for the hydrostatic balancing is absent from the working circuit of the axial piston machine and thus leads to a reduction of the efficiency of the machine.

The axial piston motor described in DE-OS 18 04 529 has the same advantages and disadvantages, in which axial piston motor there is formed in the wall of each cylinder a circumferential groove which is connected via connection channels in the cylinder drum and in the connection block to the high pressure line of an axial piston pump driving this axial piston motor.

It is the object of the invention to so further develop an axial piston machine of the kind mentioned in the introduction that while maintaining the efficiency of the machine, seizing of the pistons in the cylinders is avoided.

SUMMARY OF THE INVENTION

Instead of the principle known from the state of the art of hydraulic balancing and lubrication of the pistons, the solution in accordance with the invention is based on the principle of cooling of the critical points of metallic contact between pistons and cylinders and can thus be employed not only in oil operated axial piston machines but also in those machines which are intended for operation with a non-lubricating fluid. This cooling is effected by means of a cooling circuit which is connected to the leakage chamber, i.e. completely separated from the working circuit of the axial piston machine, and in this manner does not adversely affect its efficiency. The leakage fluid in the leakage chamber manifests its strongest cooling effect in the start-up phase, that is when the danger of piston seizure is greatest, because in this phase the temperature of the leakage fluid corresponds approximately to the surrounding room temperature. Although, with continuing operation of the axial piston machine, the leakage fluid in the leakage chamber is warmed to higher temperatures, its cooling effect is sufficient to counter the danger of piston seizure—which is significantly reduced due to the piston lubrication which has now come into action—because of the temperature difference, corresponding to the pressure difference, with regard to the fluid standing under high pressure in the working circuit.

In this context it is possible to provide a cooling device for cooling the leakage fluid in the cooling circuit. This cooling device may be constituted in the form of a further leakage fluid receiving chamber in a connection block placed on the housing and containing pressure and suction channels of the axial piston machine.

The cooling regions are preferably formed as annular chambers which surround the cylinders with slight radial spacing. With axial piston machines which are operated with oil it is advantageous to form the cooling regions as annular grooves in the cylinder walls so that the leakage oil serves not only for cooling but at the same time also for additional lubrication of the piston. The arrangement and the number of the annular chambers or annular grooves can be determined in accordance with the respective operating conditions of the axial piston machine. Thus, with axial piston machines of lesser power, it may be sufficient to associate with each cylinder a single cooling region, preferably in the end region of the cylinder drum towards the stroke disc. To this upper cooling region there may be connected a distributor channel in the case of an annular channel, and a distributor groove in case of an annular groove, which surrounds the associated cylinder substantially in the manner of a spiral and which opens out at the end face of the cylinder drum towards the stroke disc. Instead of the above-mentioned upper cooling region, a lower cooling region can also be employed which is formed in the region of the cylinder drum above the piston floor when the piston is in its lower dead centre position.

With axial piston machines of higher and of highest power, there are preferably provided at least an upper and a lower cooling region, which may be connected with one another by means of a distributor channel or distributor groove. In this case, the leakage oil flow can be maintained through a supply channel opening into one of the cooling regions and a discharge channel opening out of the respective other cooling region.

Further, it is advantageous to connect the suction channel of the axial piston machine with the cooling circuit via a choke. The forced flow compelled by the choke improves the cooling characteristics since relatively cool oil always flows in from the suction channel. Further, there occurs a reduction of the pressure pulsation in the suction chamber and thereby a reduction of operating noise.

BRIEF DESCRIPTION OF THE DRAWINGS

Below, the invention will be described in more detail with reference to four exemplary embodiments and with reference to the drawings, which show.

DETAILED DESCRIPTION OF THE PREFERRED EMBODIMENTS

Figure 1:
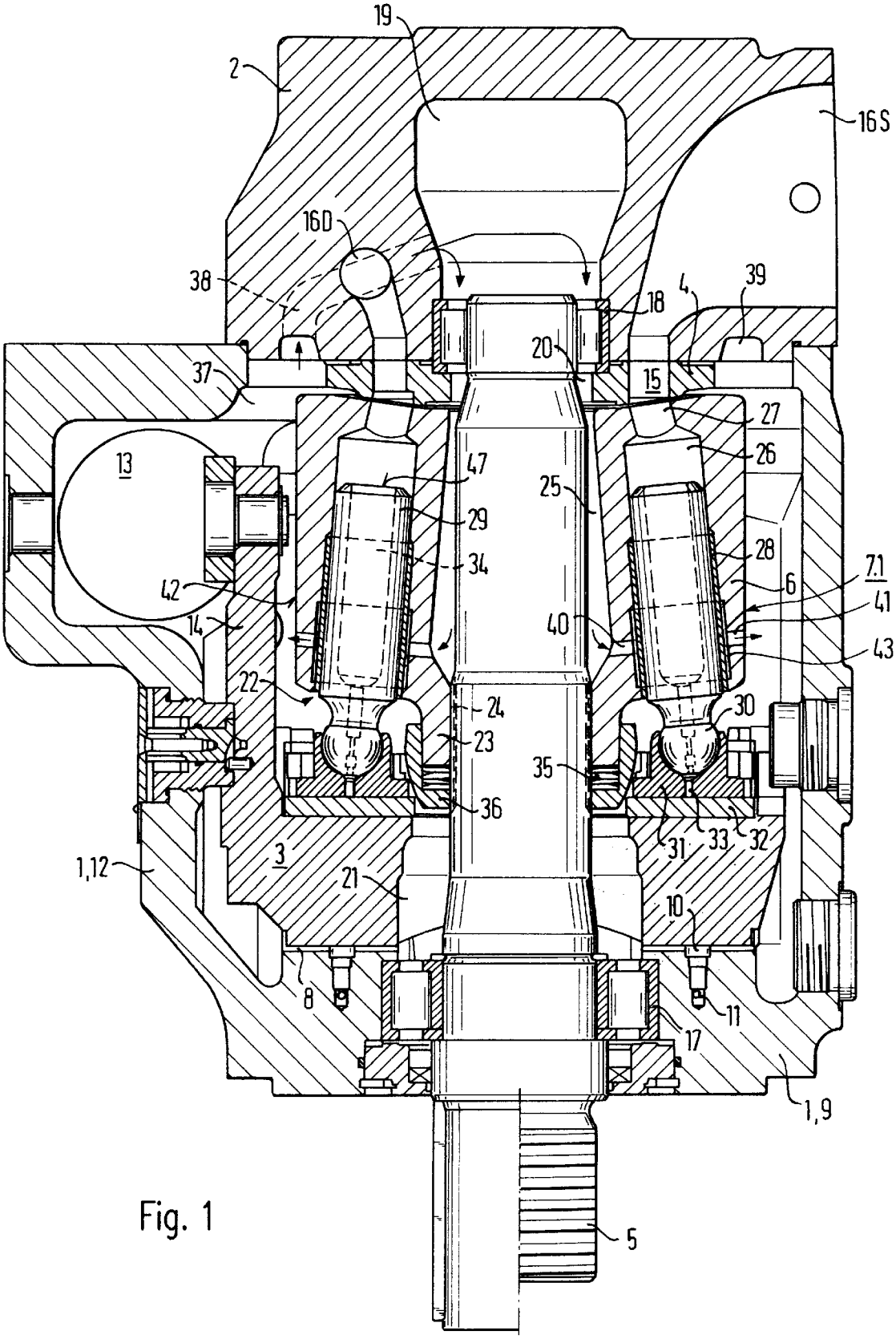
FIG. 1 as first exemplary embodiment, in axial section, an axial piston machine having a cooling circuit for cooling the cylinders and pistons in a first configuration.

The axial piston machine illustrated in FIGS. 1 to 4 is of swash plate construction having adjustable displacement volume and one flow direction and includes in known manner as main components a hollow cylindrical housing 1 having one end (the upper end in FIG. 1) open at the end face, a connection block 2 attached to the housing 1 and closing the open end of the housing, a stroke disc or swash plate 3, a control body 4, a drive shaft 5, a cylinder drum 6 and a cooling circuit 7.1; 7.2; 7.3 and 7.4 provided, respectfully, one each, in the associated embodiment of respectively FIGS. 1 to 4 of the drawings.

Figure 5:
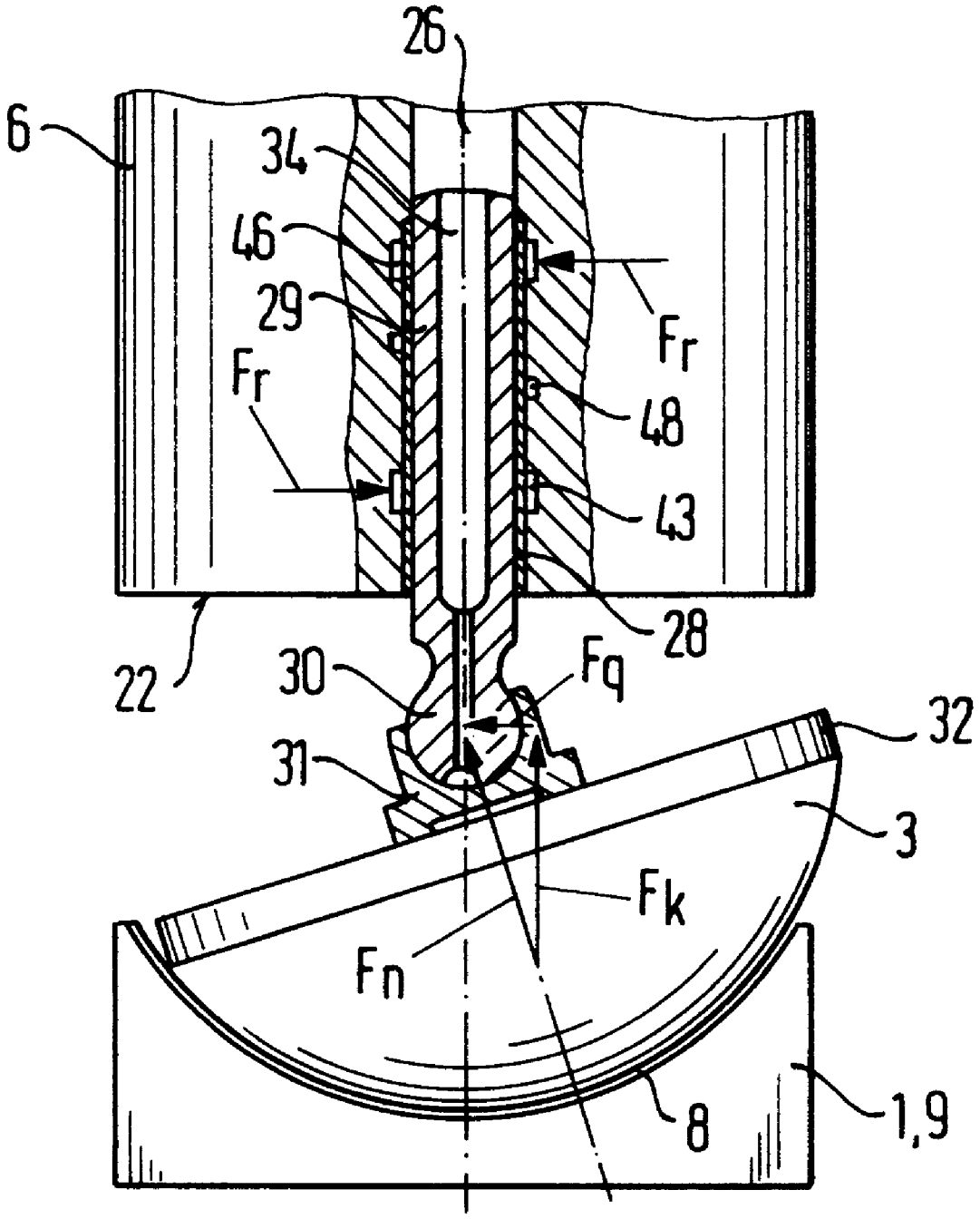
FIG. 5 an axial section, in a schematic representation, along the line V—V in FIG. 4, which shows the forces acting on the piston of the axial piston machine according to FIGS. 1 to 4.

The swash plate 3 is formed as so-called tilting rocker having a half-cylindrical cross-section (c.f. FIG. 5) and bears with two bearing surfaces, extending parallel to the tilt direction and with mutual spacing, under hydrostatic balancing, on two correspondingly formed bearing shells 8 which are attached to the inner surface of the housing end wall 9 opposite to the connection block 2. The hydrostatic balancing is effected in known manner via pressure pockets 10 which are formed in the bearing shells 8 and are supplied with pressure medium via connections 11. A setting device 13 accommodated in a bulge in the cylindrical housing wall 12 engages the swash plate 3 by means of an arm 14 extending in the direction of the connection block 2 and serves for tilting the swash plate around a tilt axis perpendicular to the tilt direction.

The control body 4 is attached on the inner surface of the connection block towards the housing inner chamber and is provided with two through-going openings 15 in the form of kidney-shaped control slots which are connected via a pressure channel 16D and suction channel 16S in the connection block 2 to a pressure and suction line (not shown). The pressure channel 16D has a smaller cross-section than the suction channel 16S. The spherically formed control surface of the control body 4, towards the housing inner chamber, serves as bearing surface for the cylinder drum 6.

The drive shaft 5 penetrates through a through-bore in the housing end wall 9 into the housing 1 and is rotatably mounted by means of a bearing 17 in this through-bore and by means of a further bearing 18 in a narrow bore section of a blind bore 19 in the connection block 2, which blind bore is widened towards its end, and in a region of a central through-bore 20 in the control body 4 bounding on this narrow bore section. The drive shaft 5 penetrates, in the interior of the housing 1, further a central through-bore 21 in the swash plate 3, the diameter of which is dimensioned correspondingly to the largest tilt movement of the swash plate 3, and a central through-bore, having two bore sections, in the cylinder drum 6.

One of these bore sections is formed in a sleeve-like extension 23 formed on the cylinder drum 6 and extending beyond the end face 22 of the cylinder drum towards the swash plate 3, via which extension the cylinder drum 6 is connected for rotation with the drive shaft 5 by means of a splined connection 24. The remaining bore section is formed with a conical development; it tapers starting from its cross-section of largest diameter near to the first bore section down to its cross-section of smallest diameter near to the end or bearing surface of the cylinder drum 6 abutting on the control body 4. The annular chamber defined by the drive shaft 5 and this conical bore section is indicated with the reference sign 25.

The cylinder drum 6 has generally axially running, stepped cylinder bores 26 which are arranged evenly on a pitch circle coaxial with the drive shaft axis, and which open at the cylinder drum end face 22 directly and at the cylinder drum bearing surface towards the control body 4 via opening channels 27 on the same pitch circle as the control slots. Respective bushes 28 are placed in the cylinder bore sections of larger diameter which open directly at the cylinder drum end face 22. The cylinder bores 26 together with the bushes 28 are here referred to as cylinders. Within these cylinders 26, 28, displaceably arranged pistons 29 are provided at their ends towards the swash plates 3 with ball heads, which are mounted in slippers 31 and via these are mounted hydrostatically on an annular slide disc 32 attached to the swash plate 5. Each slipper 31 is provided at its slide surface towards the slide disc 32 with a respective pressure pocket (not shown) which is connected with a stepped axial through-channel 34 in the piston 29 via a through-bore 33 in the slipper 31 and in this way is connected with the working chamber of the cylinder bounded by the piston 29 in the cylinder bore 26. In each axial through-channel 34 in the region of the associated ball head 30, there is formed a choke. A holding-down device 36, arranged axially displaceably on the drive shaft 5 by means of the splined connection 24 and acted upon by means of a spring 35 in the direction of the swash plate 3, holds the slippers 31 in abutment on the slide disc 32.

The space within the housing interior which is not taken up by the components 3 to 6 etc. therein accommodated serves as leakage chamber 37 which receives the leakage fluid emerging in operation of the axial piston machine through all gaps, such as for example between the cylinders 26, 28 and the pistons 29, the control body 4 and the cylinder drum 6, the swash plate 3 and the slide disk 32, and the bearing shells 8 etc.

The functioning of the above-described axial piston machine is generally known and in the following description, relating to use as a pump, is restricted to that which is significant.

The axial piston machine is provided for operation with oil as fluid. Via the drive shaft 5, the cylinder drum 6 together with the pistons 29, is set into rotation. When, through actuation of the setting device 13, the swash plate 3 is tilted into a tilted position (c.f. FIG. 5) with respect to the cylinder drum 6, all pistons 29 carry through stroke movements; with rotation of the cylinder drum 6 through 360° C. each piston 29 runs through a suction and a compression stroke whereby corresponding flows of oil are generated, the supply and discharge of which are effected via the opening channels 27, the control slits 15 and the pressure and suction channels 16D, 16S. Thereby, during the compression stroke of each piston 29, pressure oil runs from the cylinder 26, 28 concerned via the axial through-channel 34 and through-bore 33 in the associated slipper 31 into the pressure pocket thereof and builds up a pressure field between the slide disc 32 and the respective slipper 31, which serves as hydrostatic bearing for the latter. Further, pressure oil is delivered into the pressure pockets 10 in the bearing shells 8, for hydrostatic support of the swash plate 3, via the connections 11.

During the compression stroke, a normal force $F_n$ is exercised by the swash plate 3 on each slipper 31, which force, with negligible friction, acts vertically on the swash plate 3. In the ball piston 30, this normal force is resolved into a piston force $F_k$ and a radial or transverse force $F_q$. The transverse force $F_q$ acts in the ball head 30 on the piston 29 as upon a bar mounted in the cylinder drum 6, which brings about the axial reaction forces $F_r$, with corresponding spacing of their actions and oppositely directed, indicated in FIG. 5. Thereby, the piston 29 comes into metallic contact with the bush 28, whereby very high surface compressions can appear, which are the cause of corresponding high frictional forces and therewith heating at the contact point. With conventional axial piston machines, without the cooling circuit 7.1 to 7.4 in accordance with the invention, this can—particularly during the start-up phase, in which there is not yet present sufficient piston lubrication by means of the pressure oil in the cylinders 26, 28—lead to seizing of the pistons 29 and therewith to corresponding damage thereof and of the cylinders 26, 28.

The cooling circuit 7.1 to 7.4 illustrated with regard to each respectively associated embodiment shown in FIGS. 1 through 4 of the invention is connected to the leakage chamber 37 and includes the conical annular chamber 25 (so-called leakage fluid receiving chamber), the through-bore 20 in the control body 4, the blind bore 19 (so-called further leakage fluid receiving chamber), a connection line 38 connecting the latter with the leakage chamber 37, which connection line opens into a circular groove 39 in the inner surface of the connection block 2, along with the cooling regions associated around the cylinders 26, 28, which are connected via supply channels 40 to the conical annular chamber 25 and which open out via discharge channels 41 at the cylindrical boundary surface 42 of the cylinder drum 6 into the leakage chamber 37. All supply channels 40 open from the conical annular chamber 25 at its cross-section of largest diameter and proceed, as with all discharge channels 41, in substance radially through the cylinder drum 6.

In the configuration according to FIG. 1, there is associated with each cylinder 26, 28 a cooling region in the form of an annular chamber 43 which is formed as a circumferential groove in the wall of the cylinder bore section of greater diameter and is covered by the bush 28. The annular chamber 43 extends from the vicinity of the opening region of the cylinder bore 26 over about two thirds of the length of the same in the direction of the opening channels 27 and thus represents an upper cooling region associated with the upper dead centre position of the piston 29. A supply channel 40 and a discharge channel 41 open approximately in the middle into the annular chamber 43 and run coaxially with one another.

The centrifugal forces which arise in operation of the axial piston machine upon rotation of the drive shaft 5 and the cylinder drum 6 place the leakage oil located in the annular chamber 25 under a slight over-pressure which brings about a leakage oil flow via the supply channels 40, the annular chambers 43 and the discharge channels 41 to the leakage chamber 37 and from this via the connection line 38, the blind bore 19 and the through-bore 20 back into the annular chamber 25. Thereby, the energy of motion of the flowing leakage oil is converted into pressure in the annular chamber 25 which widens in the direction of flow and thereby manifests a diffusor effect, which increases the speed of flow in the cooling circuit 7.1. The generated heat in particular upon tilting out of the axial piston pump to greatest displacement volume (corresponding to the largest tilted position of the swash plate 3) due to the correspondingly high reaction forces $F_r$, is to a significant proportion transported away into the leakage chamber 37 by means of the leakage oil flowing into the annular chambers 43 around the bushes 28. Since the pressure difference of at maximum almost 400 bar between the pressure oil delivered by the axial position machine, standing under high pressure, and the leakage oil in the leakage chamber 37 corresponds to a temperature difference of about 7° C. per 100 bar, the critical points of the metallic contact between the pistons 29 and the bushes 28 are effectively cooled and thus the seizing of the piston 29 prevented. With continuing operation of the axial piston machine, the leakage oil in the leakage chamber 37, which becomes warmer, is cooled by flowing through the blind bore 19 in the connection block 2 since this connection block is exposed to the room temperature and is thus cooler than the leakage oil in the leakage chamber 37. Through corresponding configuration of the connection block 2 and of the blind bore 19, and if appropriate through additional cooling of the same by means of a separate cooling medium, the leakage oil in the cooling circuit 7.1 can be held at correspondingly lower temperatures. The cooling circuit 7.1 serves exclusively as a cooling circuit, because there is no connection with the cylinders 26, 28 (due to the closed annular chambers 43). Since the above-described axial piston machine is provided for operation with oil, the cooling circuit 7.1 can additionally assume a lubrication function if, for example, the annular chambers 43 are connected with the cylinders 26, 28 by way of corresponding bores through the bushes 28. The axial piston machine equipped with the cooling circuit 7.1 is, for reason of the arrangement of the annular chambers 43 in the opening region for the cylinders 26, 28 configured for medium power.

Figure 2:
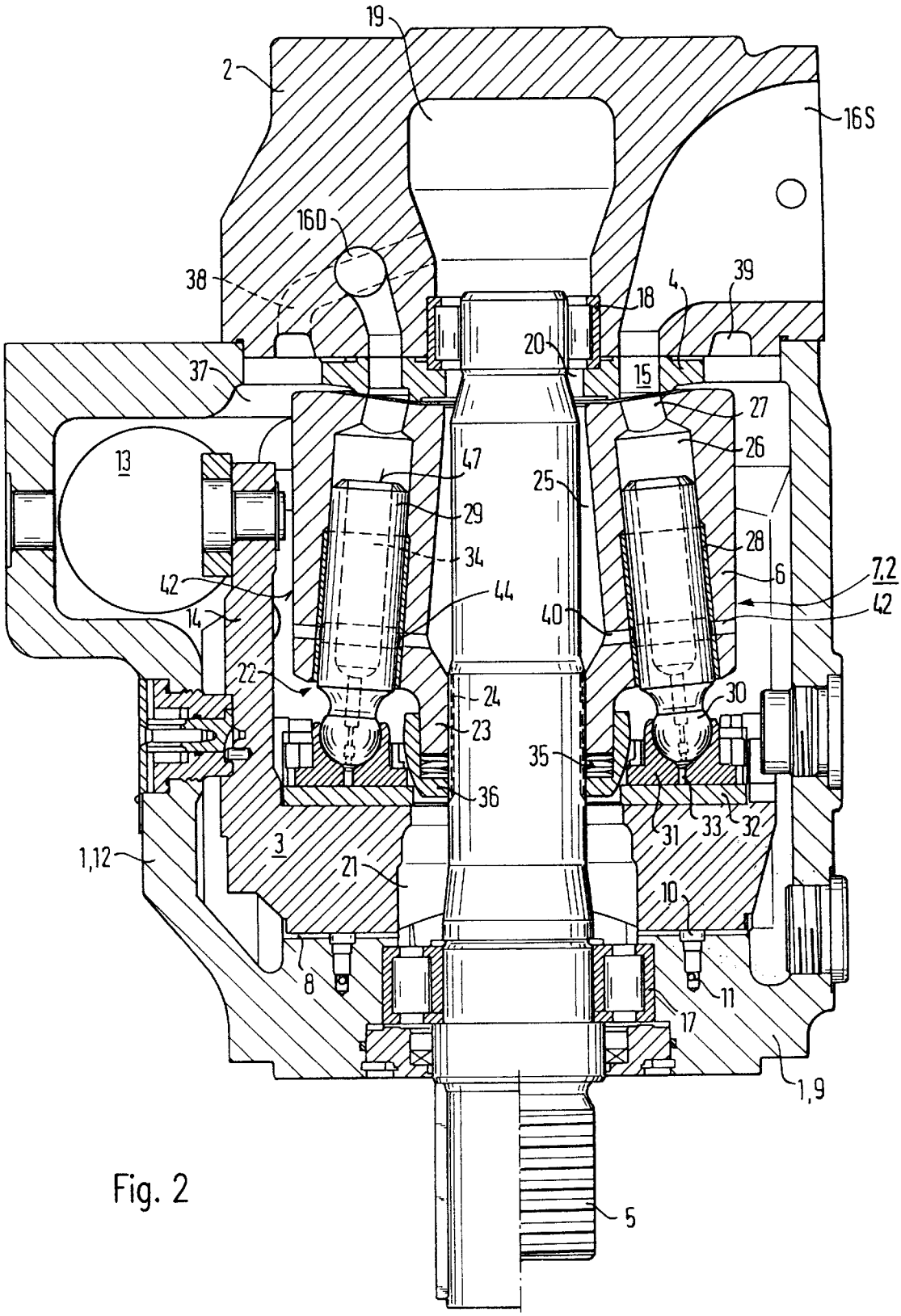
FIG. 2 as second exemplary embodiment, the axial piston machine according to FIG. 1, in axial section, having a cooling circuit in a second configuration.

The cooling circuit 7.2 according to FIG. 2 differs from that of FIG. 1, with otherwise similar construction and cooling function, in that its cooling regions have the form of annular grooves 44 which are formed in the bushes 28 and are open towards the interior of the cylinders 26, 28. The axial piston machine equipped with the cooling circuit 7.2 is, due to the lesser axial width of the annular grooves 44 in comparison to the annular chambers 43, configured for lesser power than the axial piston machine of FIG. 1 and assumes at the same time an additional lubrication of the pistons 29.

Figure 3:
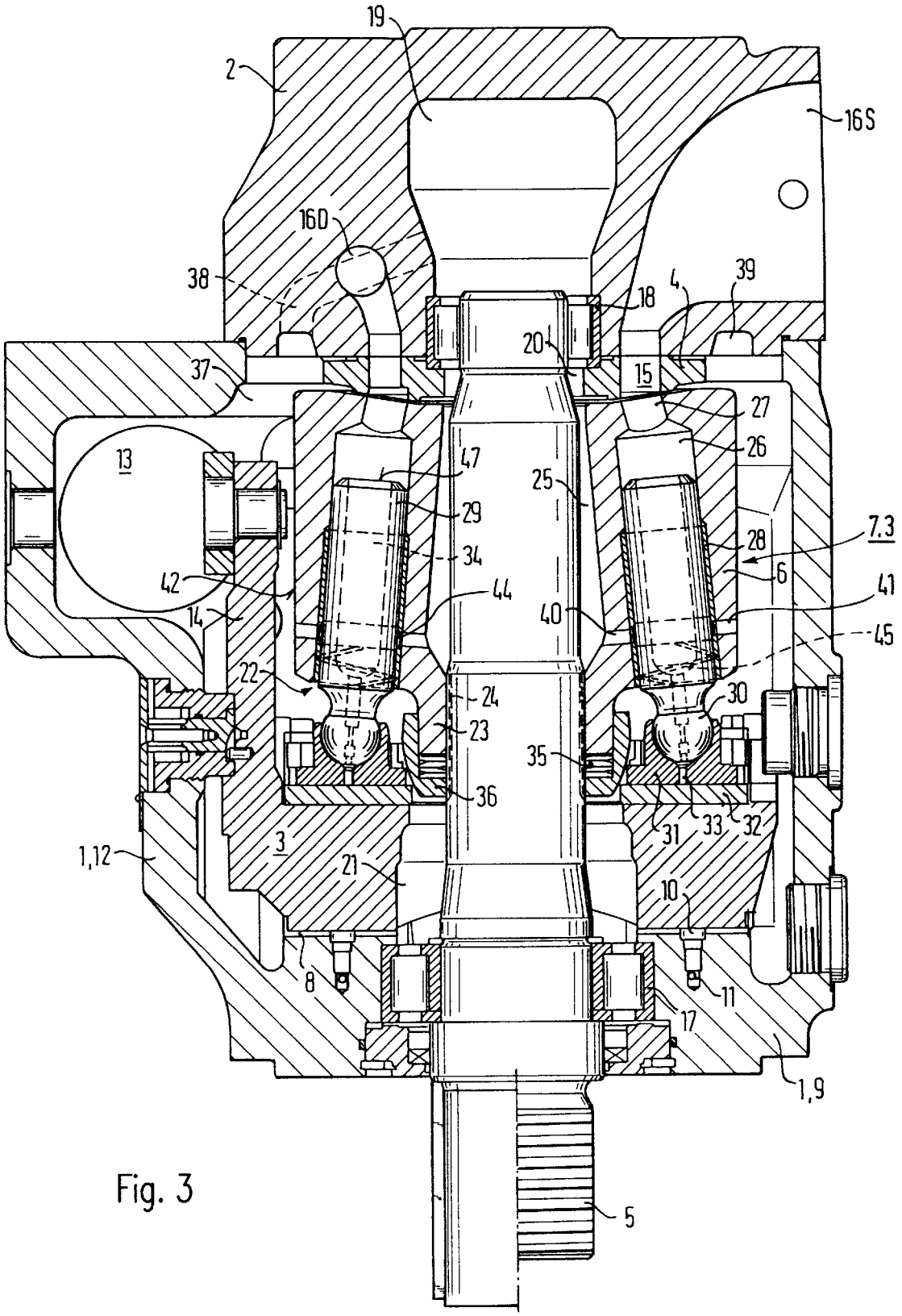
FIG. 3 as third exemplary embodiment, the axial piston machine according to FIG. 1, in axial section, having a cooling circuit in a third configuration.

The cooling circuit 7.3 according to FIG. 3 differs from that of FIG. 2, with otherwise similar construction and function, in that a distributor groove 45 is connected to each annular groove 44, which distributor groove is formed in the bush 28 encircling it in a spiral manner and opening out at the end face 22 of the cylinder drum 6. The effective range of the cylinder grooves 44 with regard to cooling and lubrication is extended up to the opening of the cylinders 26, 28 by means of the leakage oil flowing out of those grooves via the distributor grooves 45 into the leakage chamber 37.

Figure 4:
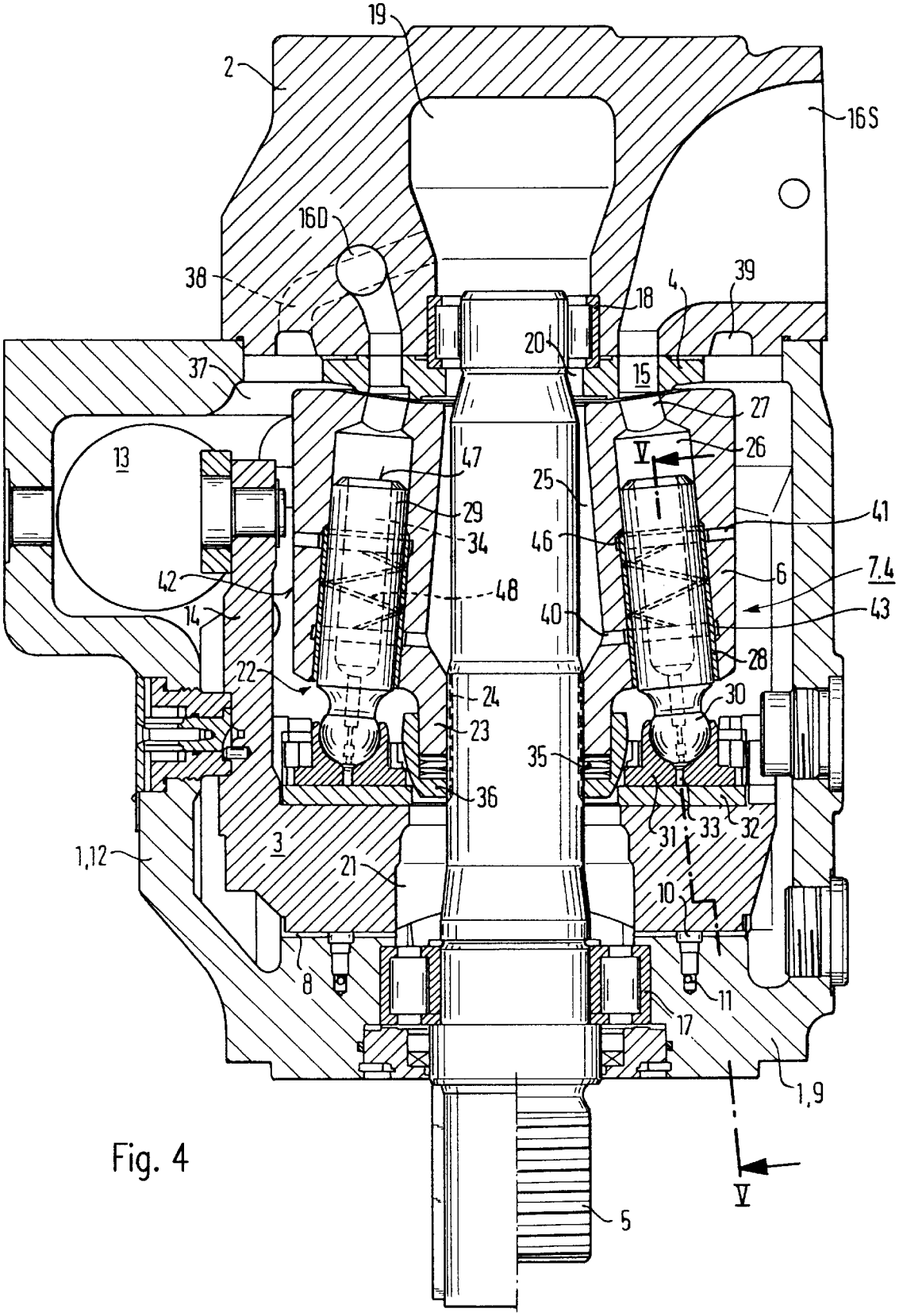
FIG. 4 as fourth exemplary embodiment, the axial piston machine according to FIG. 1, in axial section, having a cooling circuit in a fourth configuration.

The cooling circuit 7.4 in accordance with FIG. 4 includes for each cylinder 26, 28 the upper annular chamber 43 illustrated in FIG. 1, however with a lesser axial width, and a further, lower annular chamber 46 of the same dimensions which is formed in the lower end region of the bush 28, i.e. in the region of the cylinder 26, 28 above the piston floor 47 when the piston 29 is in the lower dead centre position. At the upper annular chamber 43 there is connected a supply channel 40 and at the lower annular chamber 46 there is connected a discharge channel 41. For maintaining the leakage oil flow there is provided a distributor channel 48 which connects the two annular chambers 43, 46 with one another. The cooling circuit 7.4 according to FIG. 4, like that according to FIG. 1, does not stand in connection with the cylinders 26, 28 and thus has solely the function of cooling. Since this cooling takes place at the two critical positions of metallic contact between piston 29 and running sleeve 28, and in the region located therebetween, the cooling circuit 7.4 is provided for axial piston machines of very high power. This cooling circuit can find employment for axial piston machines of the highest power when the annular chambers 43, 46 and if appropriate the distributor channels 48 stand in connection with the cylinders 26, 28 via corresponding bores through the bushes 28. The same effect is attained when the annular chambers 43, 46, the distributor channels 48 and the above-mentioned bores are replaced by annular grooves and distributor grooves in accordance with FIG. 3.

Figure 6:
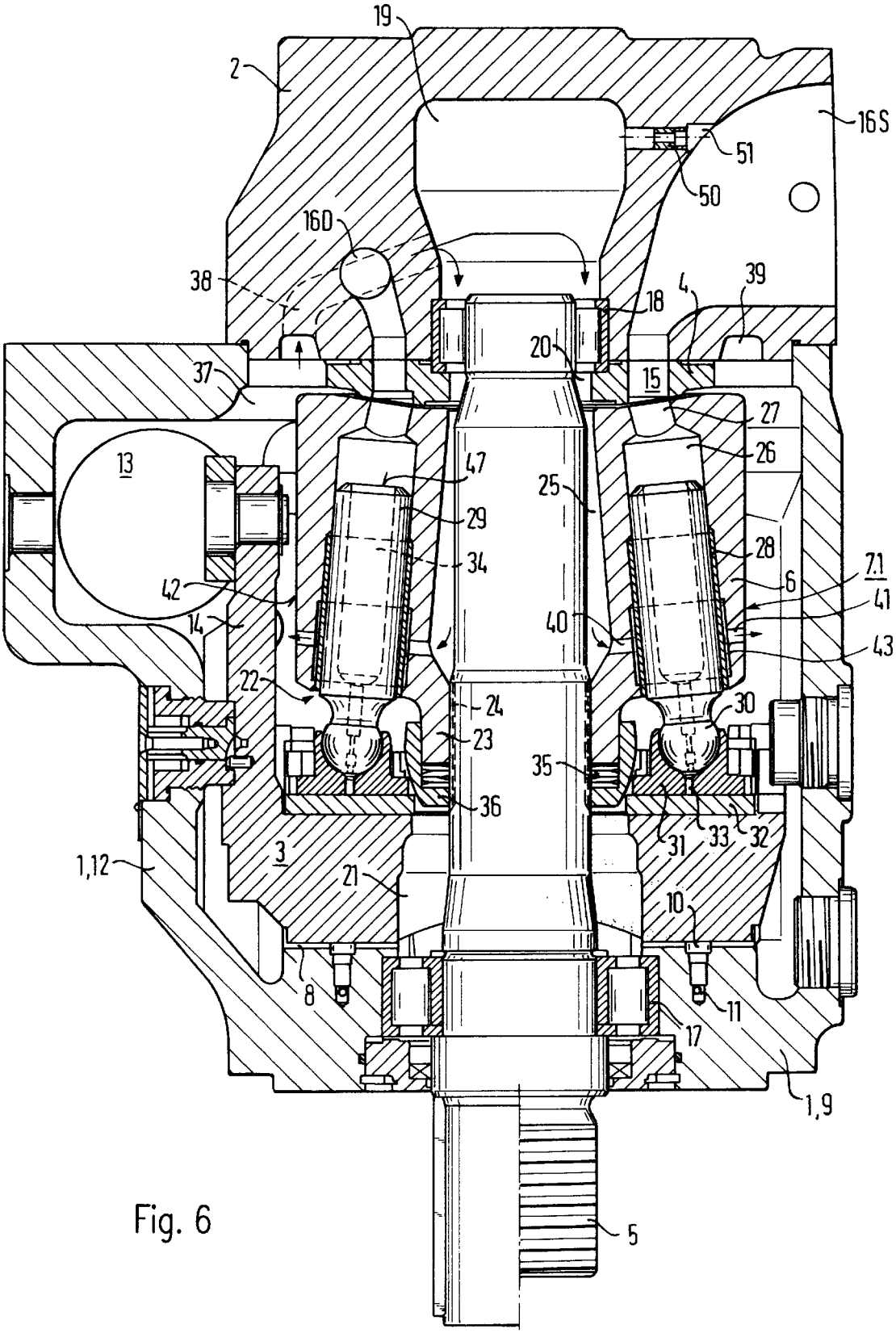
FIG. 6 as fifth exemplary embodiment, the axial piston machine according to FIG. 1, in axial section, having a cooling circuit which is connected with the suction channel by means of a choke.

FIG. 6 shows the cooling circuit 7.1 already illustrated in FIG. 1. However, the exemplary embodiment illustrated in FIG. 6 differs from that according to FIG. 1 in that between the suction channel 16S and the blind bore 19 there is provided a through-bore 51 which connects the suction channel 16S of the axial piston machine with the cooling circuit 7.1. An anti-pulsation choke 50 is arranged in the bore 51. Via the anti-pulsation choke 50 the fluid of the suction channel 16S, which is subjected to a pre-compression, flows into the cooling circuit 7.1, whereby leakage losses are compensated. Through the fluid flowing across the choke 50 there is achieved a certain forced flow in the cooling circuit 7.1, whereby the cooling characteristics of the cooling circuit are improved. Further, through the supply flow of the fluid from the suction channel 16S, which is at a lower temperature, an effective cooling of the fluid circulated in the cooling circuit 7.1 is attained. As a further advantage there is provided, through the employment of the anti-pulsation choke 50, a reduction of pressure pulsation in the suction channel 16S, which leads to a significant reduction of operation noise.

The supply from the suction channel 16S may be arranged at various positions of the axial piston machine and can open into various regions of the cooling circuit. The arrangement of the throttle 50 in the connection block 2, where the throttle can be integrated in simple manner between the blind bore 19 and the suction channel 16S, is however particularly advantageous.

Of course, the anti-pulsation choke 50 illustrated in FIG. 6 can also be put to employment with the exemplary embodiments described above with reference to FIGS. 2 to 4, without further ado.

The above-mentioned configurations of the cooling regions are exemplary and may be altered to adapt to the operating requirements in each case. Thus, it is for example possible, in the cooling circuit according to FIG. 4, to connect the two annular chambers or annular grooves each to a respective supply channel and a discharge channel and to omit the distributor channels or the distributor grooves.

The invention can also be realized in bent-axis machines, since also here there can appear radial forces skewing the pistons in the cylinders; this because of an oblique positioning of the piston or piston rods as a consequence of deviations between the pitch circles of the ball seats in the drive disc, appearing as an ellipse, and the pitch circle of the cylinders.

I claim:

1. Axial piston machine having a housing (1) with an interior housing chamber connected at one end with a connecting block, said housing chamber includes a first leakage chamber (37), a swash plate (3), a rotatably mounted cylinder drum (6) having cylinders (26, 28) and pistons (29) reciprocally movable in the cylinders, said pistons have a plurality of ends that project out of the cylinders (26, 28) and bear on the swash plate (3), first leakage fluid receiving chamber (25) is formed in a sleeve chamber, between a central opening in the cylinder drum and a drive shaft, said drive shaft is rotatively disposed in the central opening of the cylinder drum and surrounded by the cylinders (26, 28) in the cylinder drum (6) a plurality of supply and discharge channels (40, 41) are radially disposed through the cylinder drum (6), a cooling circuit is comprised of: a connection line (38) connected to the first leakage fluid receiving chamber (25) with the first leakage chamber (37), a cooling region (43, 44, 46) in the interior wall of the cylinders (26, 28) for cooling the cylinders, the cooling regions are connected by the supply channels (40) of the cooling circuit (7.1 to 7.4) to the first leakage fluid receiving chamber (25) and open out through the discharge channels (41) to the first leakage chamber, (19) for cooling the leakage fluid in the cooling circuit (7.1 to 7.4), and the first leakage fluid receiving chamber (25) widens in the direction of flow to an opening of the supply channels (40).

2. Axial piston machine according to claim 1, wherein the connection block has a second leakage fluid receiving chamber with pressure and suction channels, and said connection block is connected to the housing.

3. Axial piston machine according to claim 2, wherein the first and second leakage fluid receiving chambers, are connected and disposed on the same coaxially line, said drive shaft is centrally disposed in the cylinder drum and penetrates the second leakage fluid receiving chamber, and said cylinder drum (6) rotates on the drive shaft (5).

4. Axial piston machine according to claim 1, wherein annular chambers define cooling channels which surround the interior walls of the piston cylinders (26, 28) with a slight radial spacing.

5. Axial piston machine according to claim 1, wherein the cooling regions are formed as annular grooves (44) in the walls of the cylinders (26, 28).

6. Axial piston machine according to claim 1, wherein a distributor groove is connected to a distributor channel, said channel encircles the piston cylinder in a spiral manner and opens radially out of an end face of the cylinder drum towards the side walls of the housing.

7. Axial piston machine according to claim 1, wherein there is associated with each cylinder at least an upper cooling region (43) in the end region of the cylinder drum (6) towards the stroke disk (3).

8. Axial piston machine according to claim 7, wherein there is associated with each cylinder at least a lower cooling region (46) in the region thereof above the piston floor (47) when in the lower dead center position of the piston (29).

9. Axial piston machine according to claim 1, wherein a distributor channel or distributor groove connects upper and lower cooling chambers.

10. Axial piston machine according to claim 1, wherein there is associated with one of two cooling regions (43) at least one supply channel (40) and with the other cooling region (46) at least one discharge channel (41).

11. Axial piston machine according to claim 10, wherein the at least one supply channels and the at least one discharge channels extend substantially radial to the axial center of the drive shaft.

12. Axial piston machine according to claim 10, wherein the cooling circuit (7.1; 7.2; 7.3 and 7.4) is connected with a suction channel (16S) of the axial piston machine by a choke (50).

13. Axial piston machine according to claim 12, wherein the choke (50) opens into the cooling circuit in a region between the leakage chamber (37) and the first leakage fluid receiving chamber (25).

14. Axial piston machine according to claim 1, wherein a choke is disposed between the first leakage chamber and the suction channel.

* * * * *